US008365803B2

(12) United States Patent
Schoenheit et al.

(10) Patent No.: US 8,365,803 B2
(45) Date of Patent: Feb. 5, 2013

(54) DEBRIS ENTRAPMENT SYSTEM

(76) Inventors: Ronald A. Schoenheit, Lake Oswego, OR (US); Andrew Schoenheit, Lake Oswego, OR (US)

( * ) Notice: Subject to any disclaimer, the term of this patent is extended or adjusted under 35 U.S.C. 154(b) by 79 days.

(21) Appl. No.: 12/908,691

(22) Filed: Oct. 20, 2010

(65) Prior Publication Data

US 2012/0097018 A1 Apr. 26, 2012

(51) Int. Cl.
*A47H 1/00* (2006.01)
*F41H 5/02* (2006.01)
*F41H 5/18* (2006.01)

(52) U.S. Cl. ..... 160/330; 89/36.02; 89/36.04

(58) Field of Classification Search ..... 160/330, 160/332, 345, 348, 349.1, 349.2, 368.1; 428/911; 52/DIG. 12; 89/36.02, 36.04
See application file for complete search history.

(56) References Cited

U.S. PATENT DOCUMENTS

| | | | | |
|---|---|---|---|---|
| 955,913 | A * | 4/1910 | Sapp | 160/398 |
| 4,201,189 | A | 5/1980 | Saunders | 126/429 |
| 4,493,358 | A * | 1/1985 | Jacobson | 160/349.1 |
| 4,582,109 | A * | 4/1986 | Fairbanks | 160/84.04 |
| 4,709,659 | A | 12/1987 | Quante, III et al. | 109/21.5 |
| 5,680,893 | A | 10/1997 | Neer | 160/330 |
| 5,688,075 | A * | 11/1997 | Gradek | 405/63 |
| 5,719,350 | A | 2/1998 | Parkes et al. | 102/303 |
| 5,832,666 | A | 11/1998 | Flack, II et al. | 49/67 |
| 5,915,449 | A * | 6/1999 | Schwartz | 160/330 |
| 6,010,758 | A | 1/2000 | Anglin, Jr. | 428/14 |
| 6,212,840 | B1 * | 4/2001 | Davidovitz | 52/506.01 |
| 6,319,571 | B1 | 11/2001 | Anglin, Jr. | 428/14 |
| 6,886,299 | B2 * | 5/2005 | Gower | 52/222 |
| 7,380,379 | B2 * | 6/2008 | Venegas, Jr. | 52/222 |
| 7,694,482 | B2 | 4/2010 | Gazaway et al. | 52/473 |
| 2003/0089052 | A1 | 5/2003 | Emek | |
| 2005/0138889 | A1 | 6/2005 | Biebuyck | 52/782.1 |
| 2006/0090862 | A1 * | 5/2006 | Messick | 160/330 |

(Continued)

FOREIGN PATENT DOCUMENTS

| | | |
|---|---|---|
| JP | 11-264252 | 9/1999 |
| JP | 2002-138678 | 5/2002 |

(Continued)

OTHER PUBLICATIONS

J. L. Smith et al., "*Safetydrape—Blast Curtain, Test Report ARA-TR-98-4626.1-2*"; Applied Research Associates, Inc.; Mar. 1998; pp. 1-6.

(Continued)

*Primary Examiner* — Katherine w Mitchell
*Assistant Examiner* — Jeremy Ramsey
(74) *Attorney, Agent, or Firm* — Dorsey & Whitney LLP

(57) ABSTRACT

Debris entrapment systems and methods for utilizing are disclosed. One such debris entrapment system includes a track configured to be mounted proximate a window opening. A plurality of slidable carriers are attached proximate an attachment edge of a mesh curtain and are configured to fit with a guide of the track and to be slidably attached to the track. A first plurality of trapped carriers are attached proximate the attachment edge and a first edge of the mesh curtain and a second plurality of trapped carriers are attached proximate the attachment edge and a second edge of the mesh curtain. The trapped carriers are configured to fit with the guide of the track and are trapped from sliding along the guide. The debris entrapment system further includes a reinforcement strip attached to the mesh curtain.

25 Claims, 10 Drawing Sheets

U.S. PATENT DOCUMENTS

| | | | | |
|---|---|---|---|---|
| 2006/0151132 | A1 | 7/2006 | Scalfani et al. | 160/268.1 |
| 2007/0000377 | A1 | 1/2007 | Ohnstad | 89/36.13 |
| 2007/0193137 | A1 | 8/2007 | DeBooth | 52/202 |
| 2008/0017333 | A1 * | 1/2008 | Chen | 160/330 |
| 2009/0127369 | A1 | 5/2009 | Mullet et al. | 242/379 |
| 2009/0183447 | A1 | 7/2009 | Hay, III et al. | 52/202 |
| 2009/0229767 | A1 | 9/2009 | Mullet et al. | 160/26 |
| 2009/0308238 | A1 | 12/2009 | Schwartz | 89/36.02 |

FOREIGN PATENT DOCUMENTS

| | | | |
|---|---|---|---|
| JP | 2003-074214 | | 3/2003 |
| KR | 10-0597228 | | 7/2006 |
| ZA | 8407616 | * | 3/1985 |

OTHER PUBLICATIONS http://web.archieve.org/web/20080228171007/www.pinaclearmor.com/facility-armor; downloaded from Pinnacle Armor website on Oct. 16, 2009; pp. 1-3.

Ansari Company; http://www.ansaricompany.com/BlastMitigationEquipment.htm; downloaded from ansaricompany.com on Oct. 20, 2010; pp. 1.

Safetydrape—Blast Curtains; "*U.S. Department of Homeland Security (DHS) Safety Act Approved Product—The Only Safety Act Approved Glass Hazard Mitigation Product Available*"; pp. 1-2; publication date unavailable.

Pinnacle Armor; "*2.2 Security Amor*"; pp. 1; publication date unavailable.

Securagard Fragment Retaining Curtain; Architectural Installation Specification; publication date unavailable.

International Search Report & Written Opinion dated Feb. 27, 2012 for PCT Application No. PCT/US2011/056940, Feb. 27, 2012, 1-8.

* cited by examiner

DEBRIS ENTRAPMENT SYSTEM

TECHNICAL FIELD

Embodiments of the invention relate generally to blast debris entrapment systems, and in one or more of the illustrated embodiments, a debris entrapment system having a mesh curtain for entrapping airborne debris.

BACKGROUND OF THE INVENTION

The risk of injury resulting from explosions extends to those inside buildings due to airborne debris as well as shock waves caused by the explosions. Both the debris and shock waves can cause windows and doors to implode spraying glass and additional debris inward toward the interior of the building. Those people positioned near an opening when the blast occurs can be significantly injured by the flying debris.

Conventional approaches to mitigating injuries from blast damage include adding exterior or interior barriers to cover window and door openings to shield against airborne debris and shockwaves. The barriers may be constructed in a variety of manners from different materials but are typically rigid and constructed in a manner to shield as much of the opening from exposure to the explosion. The barriers are often unsightly and require extensive retrofitting or additional equipment to be mounted in place. Additionally, although the construction minimizes exposure to the blast in or to prevent damage and injury, the resulting construction effectively blocks natural light as well as preventing those inside from seeing through the opening. In some instances because the barrier blocks both light and viewing, the barriers are not positioned to cover the openings at all times but are moved into place when there is a more immediate threat of danger. The effectiveness of the barriers, however, are directly dependent on whether the barriers are positioned to shield the opening at the time an explosion occurs.

Another approach is to use metal mesh drapery positioned to catch debris in the event of an explosion that causes a window to implode. The mesh drapery allows natural light to pass and allows visibility through the window from the interior. The mesh drapery may also be constructed to be esthetically pleasing. Protection is provided by the mesh drapery as it stretches to absorb impact energy and encapsulates airborne debris while also allowing blast pressure to vent. Conventional mesh drapery designs, however, may be subject to tearing as the drape expands beyond the material limit during an explosion, and mounting the mesh drapery in position to provide an effective shield may require full-frame tracks or complicated mounting hardware.

DETAILED DESCRIPTION

Certain details are set forth below to provide a sufficient understanding of embodiments of the invention. However, it will be clear to one skilled in the art that embodiments of the invention may be practiced without these particular details. Moreover, the particular embodiments of the present invention described herein are provided by way of example and should not be used to limit the scope of the invention to these particular embodiments.

Figure 1A:
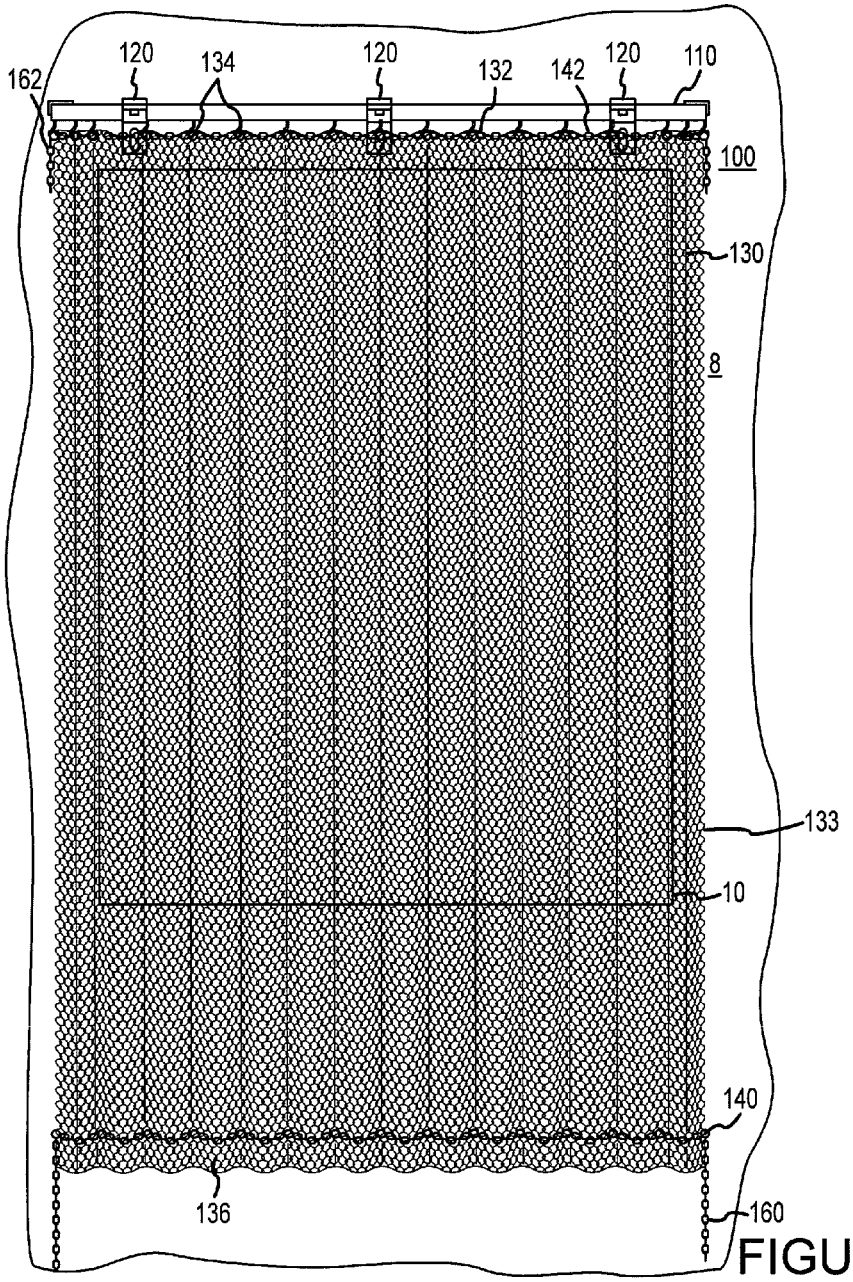
FIGS. 1A and 1B are drawings of a debris entrapment system according to an embodiment of the invention.
Figure 1B:
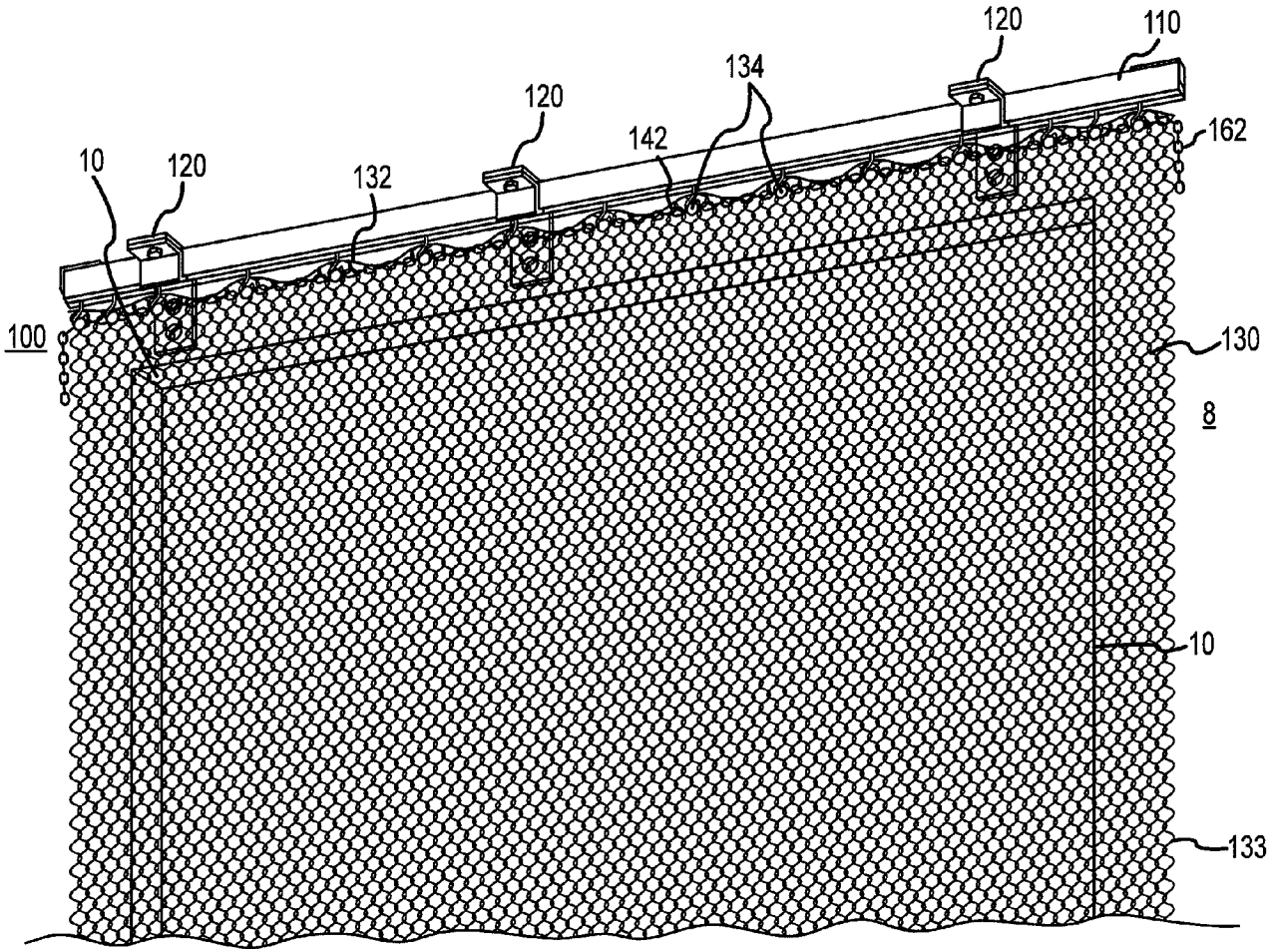

FIGS. 1A and 1B illustrate a debris entrapment system 100 according to an embodiment of the invention. The debris entrapment system 100 includes a track 110 that is mounted to an interior of a wall 8 having an opening 10. In some embodiments, for example, the embodiment illustrated in FIGS. 1A and 1B, the track 110 is mounted to a wall 8 using brackets 120. The brackets 120 are mounted to the wall using a fastener, for example, a screw, bolt, or similar fastener, and the track 110 is attached to the brackets 120. In other embodiments, the track 110 may be attached directly to the wall 8 without the use of brackets. In some embodiments, the track 110 may be attached directly to a ceiling without the use of brackets, or alternatively, with the use of brackets. A mesh curtain 130 is hung from the track 110 by carriers 134 that are attached proximate to an attachment edge 132 of the mesh curtain 130. The carriers 134 may be slidably attached to the track 110. The mesh curtain 130 is positioned substantially covering the opening 10, which may be a window. However, embodiments of the invention may be applied to other structural openings as well, for example, a doorway, skylight, or other opening. The mesh curtain 130 may have pleats 136 to provide fullness for the mesh curtain 130. In some embodiments, the pleating may provide a fullness of 100 percent, that is, the width of the material used in forming the mesh curtain 130 (as measured perpendicular to the pleats) is twice the hanging width of the mesh curtain 130. Other degrees of fullness may be used as well, preferably greater than 100 percent.

The mesh curtain 130 may be made from various materials, including metallic materials, for example, stainless steel, carbon steel, aluminum, or other metals and alloys. Non-metallic materials may be used as well. The mesh curtain 130 may be a formed from a woven wire mesh where spiral wires are interlocked with one another, for example. The wire used in the mesh may be selected from a variety of wire gauges (e.g., 14, 16, 18, and 20 gauge, as well as others), and various weave sizes (e.g., weaves between ⅛ inch to 5/16 inch, as well as others) may be used for the woven mesh of the mesh curtain. In some embodiments, the mesh curtain 130 may be made from multiple layers of mesh material, for example, a double layer or triple layer of mesh, to provide additional entrapment capabilities. Where using multiple layers of mesh, a multiple track system may be used to hang the mesh curtains, that is, each track having carriers attached to a respective mesh curtain. In other embodiments, however, multiple layers of mesh may be hung using a single track as well.

The debris entrapment system 100 further includes a reinforcement strip 140 attached to the mesh curtain 130. Threaded fasteners may be used to attach the reinforcement strip 140 to the mesh curtain 130. As will be described in more detail below, some embodiments of the invention attach to the mesh curtain 130 at attachment points, and in some further embodiments, the attachment points correspond to the pleats 136 on the mesh curtain 130. That is, each of the pleats has a respective attachment point at which the reinforcement strip 140 is attached. The reinforcement strip 140 may reinforce the mesh curtain 130 when expanding and billowing to mitigate tearing of the mesh current 130. For example, the reinforcement strip 140 can hold the pleats of the curtain proximate the location of the reinforcement strip 140 from expanding in excess of a length of the reinforcement strip 140 between two adjacent attachment points.

The reinforcement strip 140 is illustrated in FIGS. 1A and 1B as being attached proximate an edge opposite of the attachment edge 132 (e.g., bottom edge of the mesh curtain 130). Other locations for the reinforcement strip 140 may be used as well. For example, a reinforcement strip may be attached toward a middle of the mesh curtain 130 between the upper and lower edges. In some embodiments, an additional reinforcement strip 142 may be attached toward the upper edge of the mesh curtain 130 to provide reinforcement along that edge. The attachment of carriers 134 to the mesh curtain 130 may be reinforced using the reinforcement strip 142 as well, as will be explained in greater detail below. The reinforcement strips 140, 142 may have respective excess portions 160, 162, which, as will also be explained in more detail below, may be anchored to the wall 8.

The debris entrapment system 100 may be used to entrap airborne debris resulting from external explosions, for example, flying glass splinters, bomb encasement fragments, nails, ball bearings, bolts, rocks, and other debris that are propelled through or from the opening 10. The mesh curtain 130 allows the blast pressure from the explosion to pass through it while stopping or entrapping the airborne debris by becoming entangled in the interconnected mesh of the mesh curtain 130. As the debris impact and are entrapped in the mesh curtain 130, the interlocked mesh may stretch and the mesh curtain 130 billow to absorb the kinetic energy of the airborne debris, thereby preventing injury that would otherwise result.

Figure 2:
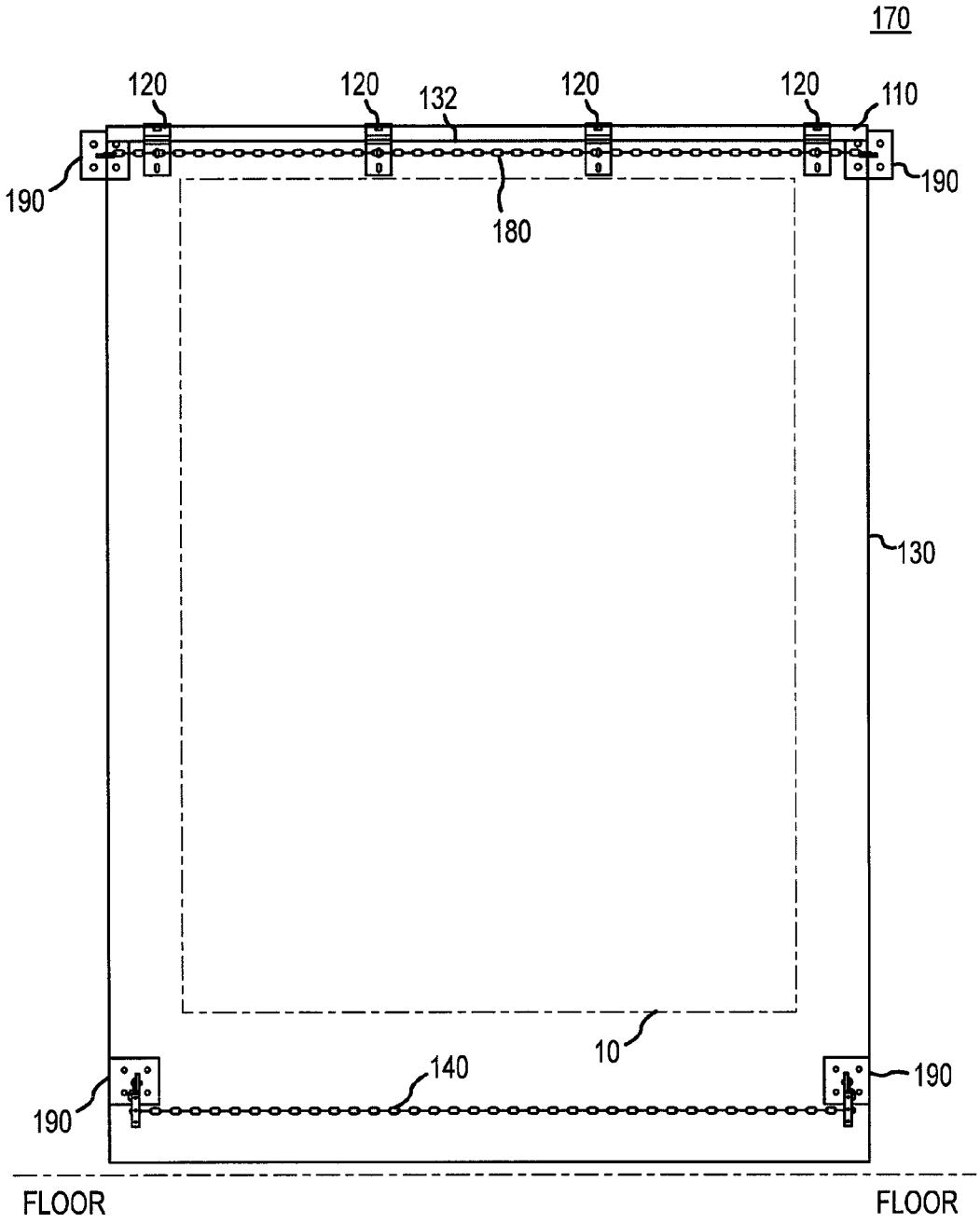
FIG. 2 is a drawing of a debris entrapment system according to another embodiment of the invention.

FIG. 2 illustrates a debris entrapment system 200 according to another embodiment of the invention. The debris entrapment system 200 includes many of the same elements as in the debris entrapment system 100 previously described with reference to FIGS. 1A and 1B. For example, the debris entrapment system 200 includes a mesh curtain 130 (outline shown in FIG. 2) that is hung by carriers (not shown) attached to a tack 110. The mesh curtain 130 is hung to cover an opening 10 (outline shown in FIG. 2). A reinforcement strip 140 is attached to the mesh curtain 130 proximate a bottom edge. Another reinforcement strip 180 is attached to the mesh curtain 130 proximate the attachment edge 132. The attachment of carriers to the mesh curtain 130 may be reinforced using the reinforcement strip 180. In the embodiment of FIG. 2, the reinforcement strips 140 and 180 are anchored to a wall using wall anchors 190. In some embodiments, the reinforcement strips 140, 180 are anchored, for example, to a ceiling, a floor, or other structures.

As previously discussed, the reinforcement strip 140 provides reinforcement to the mesh curtain 130 as debris is entrapped. The reinforcement strip 180 similarly provides reinforcement as well. The reinforcement strips 140 and 180 also prevent upper and lower edges from blowing open as the of the mesh curtain 130 billows and expands to catch debris. In some embodiments, the length of reinforcement strip between attachments points for the reinforcement strips 140 and 180 is the same. That is, the reinforcement strips 140 and 180 allow pleats of the mesh current 130 to expand at the upper and lower edges approximately the same amount. In other embodiments, the length of reinforcement strip between attachments points for reinforcement strips 140 and 180 are different, for example, the distance between attachment points for either the reinforcement strips 140 or 180 may be greater than the other to allow that edge to billow more when the mesh curtain 130 expands. Attachment of the reinforcement strips 140 and 180 may enhance the entrapment characteristics of the mesh curtain 130 and may also enhance structural integrity of the entrapment system 170. For example, anchoring the reinforcement strip 140 to the wall may prevent the lower edge of the mesh curtain 130 from flipping outward upon impact of debris and allowing fragments to spray from beneath the mesh curtain 130. Additionally, anchoring the reinforcement strip 180 can prevent the upper edge of the mesh curtain 130 from blowing out in the event track 110 fails or the track 110 is torn away from the wall from debris impact.

Figure 3:
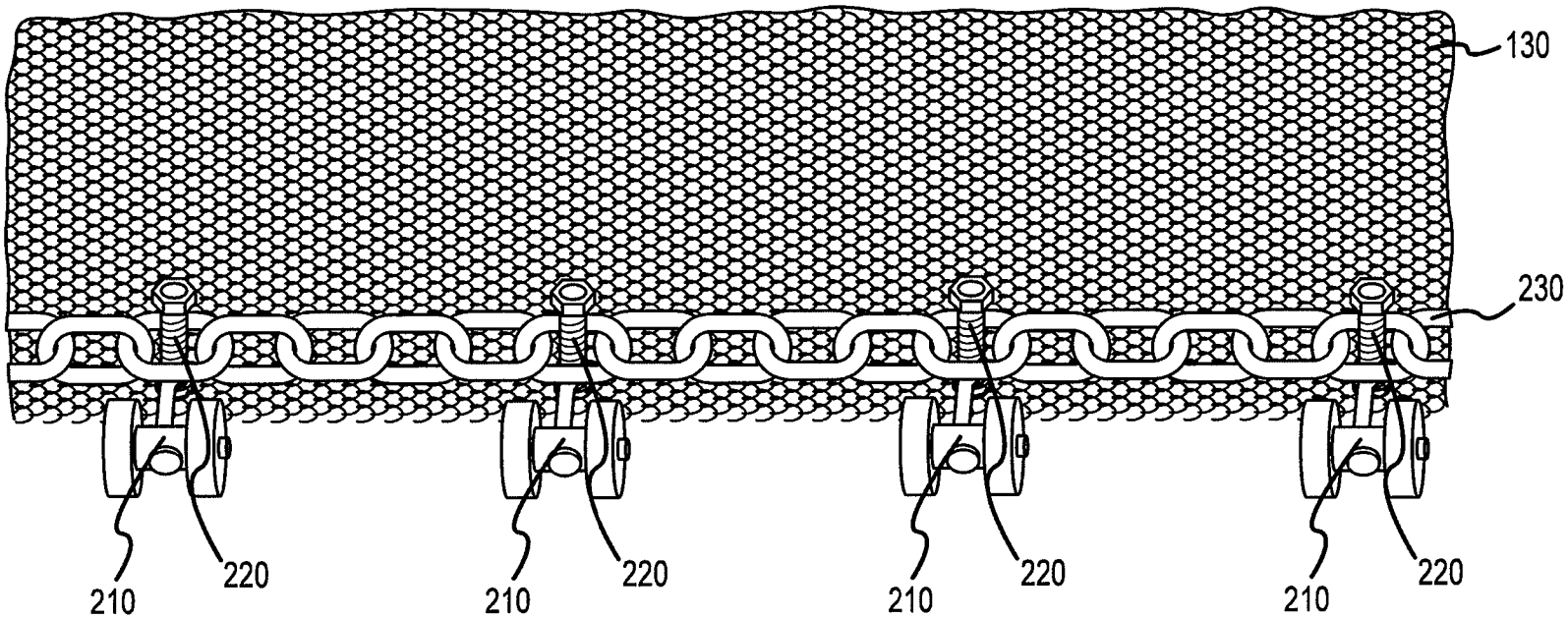
FIGS. 3 and 4 are drawings of an attachment of carriers to a mesh curtain according to an embodiment of the invention.
Figure 4:
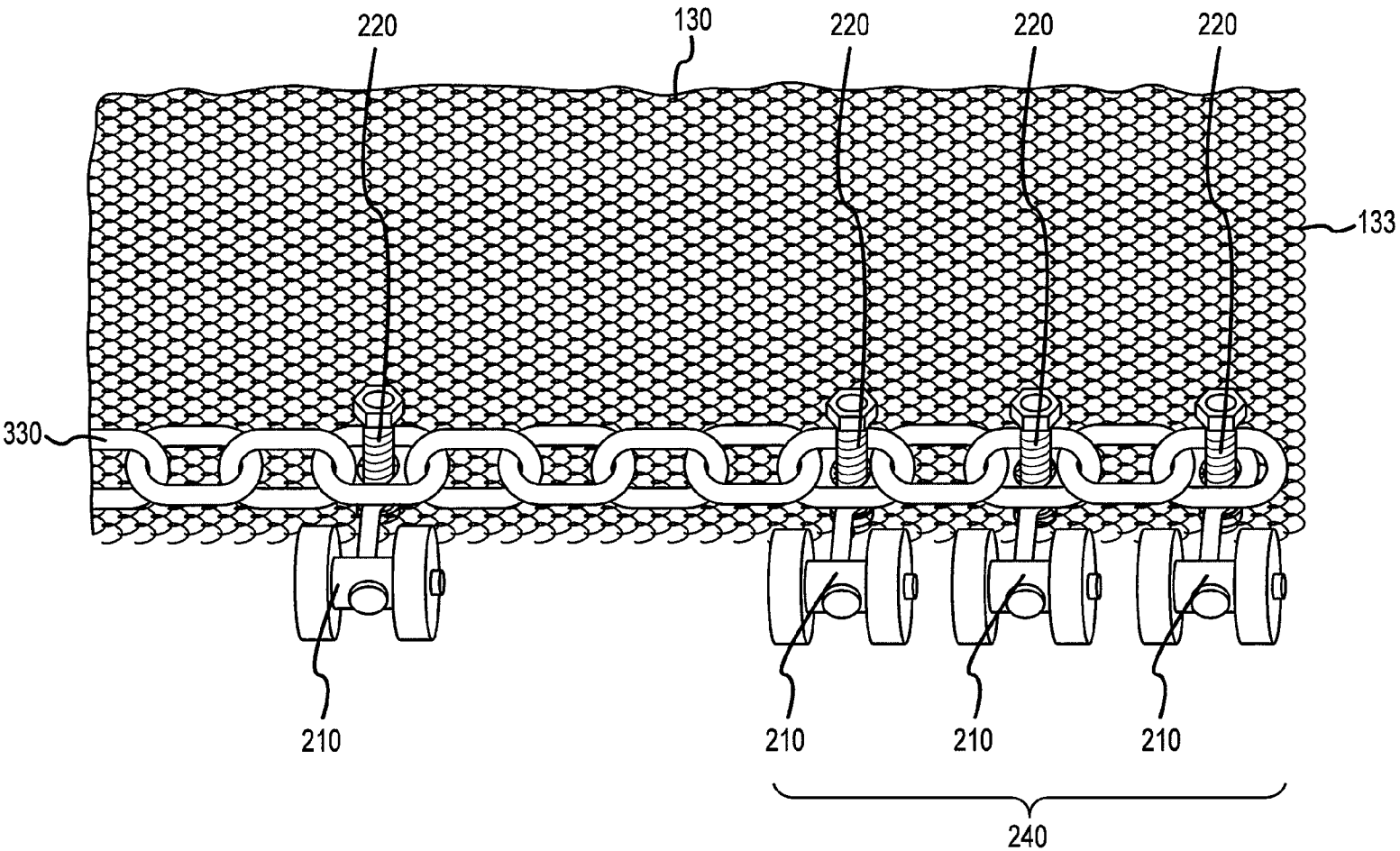

FIGS. 3 and 4 illustrate carriers 210 and the attachment of the carriers 210 to a mesh curtain, for example, mesh curtain 130 of FIGS. 1 and 2, according to an embodiment of the invention. In the embodiment of FIGS. 3 and 4, the carriers 210 are roller carriers that fit with a guide of a track (e.g., track 110 of FIGS. 1 and 2) from which the mesh curtain 130 hangs. The carriers 130 are attached to the mesh curtain 130 with fasteners 220, for example, a threaded bolt and nut, proximate an attachment edge 132.

A reinforcement strip 230 may also be attached to the mesh curtain 130 proximate the attachment edge 132. As illustrated in FIGS. 3 and 4, the reinforcement strip 230 may be a chain, however, other types of reinforcement devices may be used as well. The reinforcement strip 230 may be attached to the mesh curtain at attachment points, and in some embodiments, the attachment points correspond to pleats of the mesh curtain 130 so that the pleats are reinforced. For example, during impact of debris against the mesh curtain 130 which cause it to billow, the reinforcement strip 230 can hold the pleats of the curtain proximate the location of the reinforcement strip 230 from expanding in excess of a length of the reinforcement strip 230 between two adjacent attachment points. The length of the reinforcement strip 230 between adjacent attachment points may be less than the length of another reinforcement strip between its attachment points that is also attached to the mesh curtain 130 (e.g., reinforcement strip 140, 142, 180 of FIGS. 1 and 2), for example, in embodiments having such an arrangement of a plurality of reinforcement strips. The reinforcement strip may also have an overall length that is less than the lateral expanded length of the mesh curtain 130 but greater than the width of the window opening 10. The mesh curtain 130 is allowed to expand and billow while creating a curvature to entrap debris as the mesh curtain 130 is impacted. In some embodiments, the amount of pleated material of the mesh curtain 130 may be controlled by the distance between attachment points of a reinforcement strip. For example, the pleating of the mesh curtain 130 may be made fuller or tighter by increasing or decreasing the distance between attachment points of the reinforcement strip. As a result, the reinforcement strip can control the amount of billowing and expansion of the mesh curtain. The reinforcement strip may also help hold the mesh curtain 130 in position to trap debris rather than it blowing away or moving out of position as debris impacts the mesh curtain 130. For example, a reinforcement strip may be anchored, for example, to a wall, ceiling, floor, or other structure.

In some embodiments, for example, the embodiment shown in FIGS. 3 and 4, the reinforcement strip 230 is attached to the mesh curtain 130 using the same fasteners 220 that are used to attach the carriers 210 to the mesh curtain 130. Although FIGS. 3 and 4 illustrate a reinforcement strip 230 attached to the mesh curtain 130, the reinforcement strip 230 is optional and in some embodiments is not used.

FIG. 4 illustrates an arrangement of carriers 210 proximate a side edge 133 of the mesh curtain 130. A plurality of carriers 240 are attached in closer proximity to one another than further away from the side edge 133 of the mesh curtain 130. For example, carriers 210 further away from the side edge 133 may be attached to the mesh curtain 130 a distance "x" from one another. The plurality of carriers 240 proximate the side edge 133, however, may be attached to the mesh curtain 130 a distance less than x from one another. As will be described in greater detail below, the plurality of carriers 240 are trapped in the track (e.g., track 110 of FIGS. 1 and 2) from sliding. Trapping a plurality of carriers 240 prevents the side edge 133 from sliding inward along the track and also prevent the side edge 133 from tearing away as debris impact the mesh curtain causing it to billow. Although three carriers are shown for the plurality of carriers 240, a greater or fewer number of carriers may be used as well for other embodiments.

In other embodiments, the mesh curtain 130 may be reinforced from sliding inward along the track 110 and also prevent the side edge 133 from tearing away as debris impact the mesh curtain 130 using techniques other than trapped carriers as previously described. For example, carriers different than those used away from the side edge 133 may be used, such as reinforced carriers designed to accommodate greater loads than those used away from the side edge 133. Another example is the carriers are not roller carriers or carriers that are slidably attached to the track 110, but are fixed to the track 110 and to prevent sliding.

Figure 5:
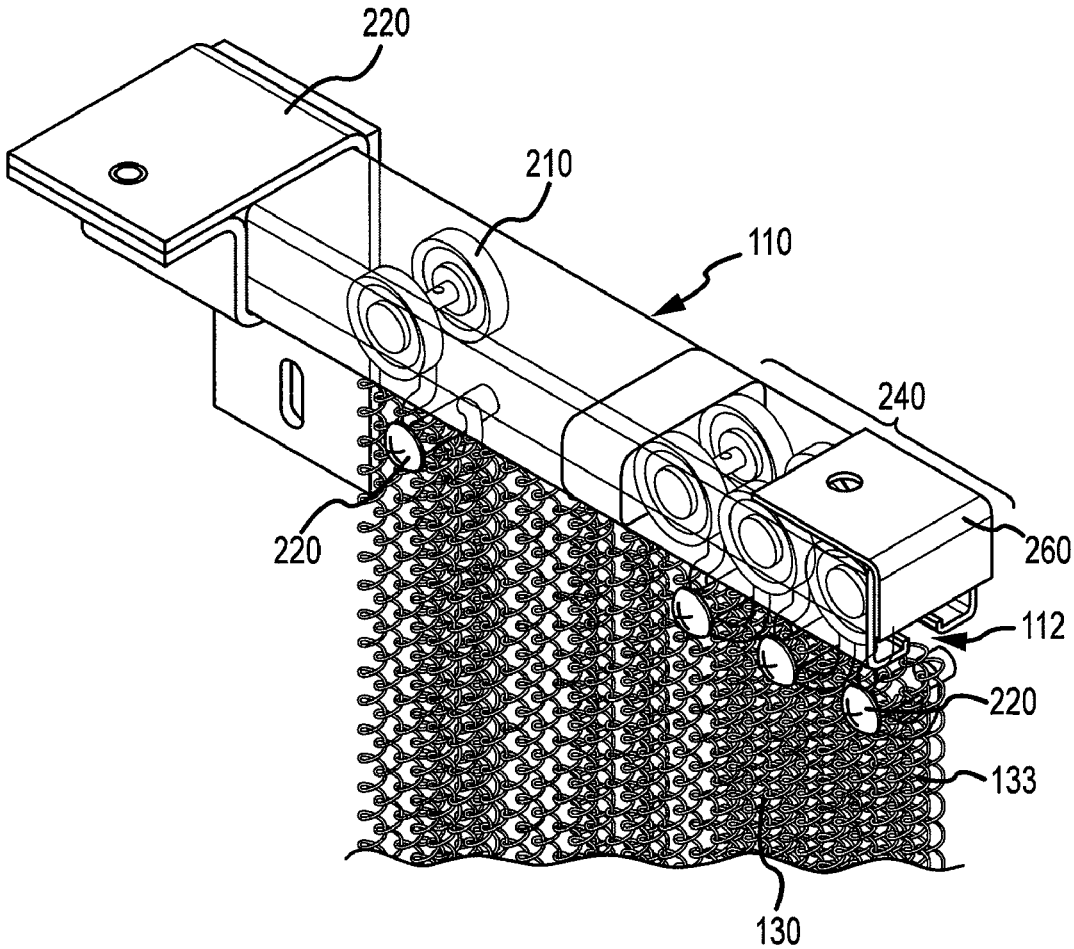
FIG. 5 is a drawing of carriers attached to a track according to an embodiment of the invention.

FIG. 5 illustrates carriers 210 attached to a track 110 according to an embodiment of the invention. Carriers 210 fit with a guide 112 of the track 110 which allow the carriers 210 to slide. The track 110 illustrated in the embodiment of FIG. 5 includes a channel guide in which roller carriers fit. As previously discussed, a plurality of carriers 240 are attached to the mesh curtain 130 proximate a side edge 133 more closely to one another than carriers (e.g., carrier 210) further away from the side edge 133, and are trapped in the track 110 from sliding in the guide 112. In the embodiment of FIG. 5, the plurality of carriers 240 are trapped in the track 110 by carrier stop 250 and end stop 260. The carrier stop 250 may be held in place in the guide 112 and the end stop 260 attached to the track 110 using conventional techniques. Other track, guide, and carrier configurations than those previously described may be used in alternative embodiments. For example, an alternative track may have an I-beam configuration to which roller carriers are slidably attached and fit with a guide defined by upper and lower flanges of the I-beam.

Figure 6:
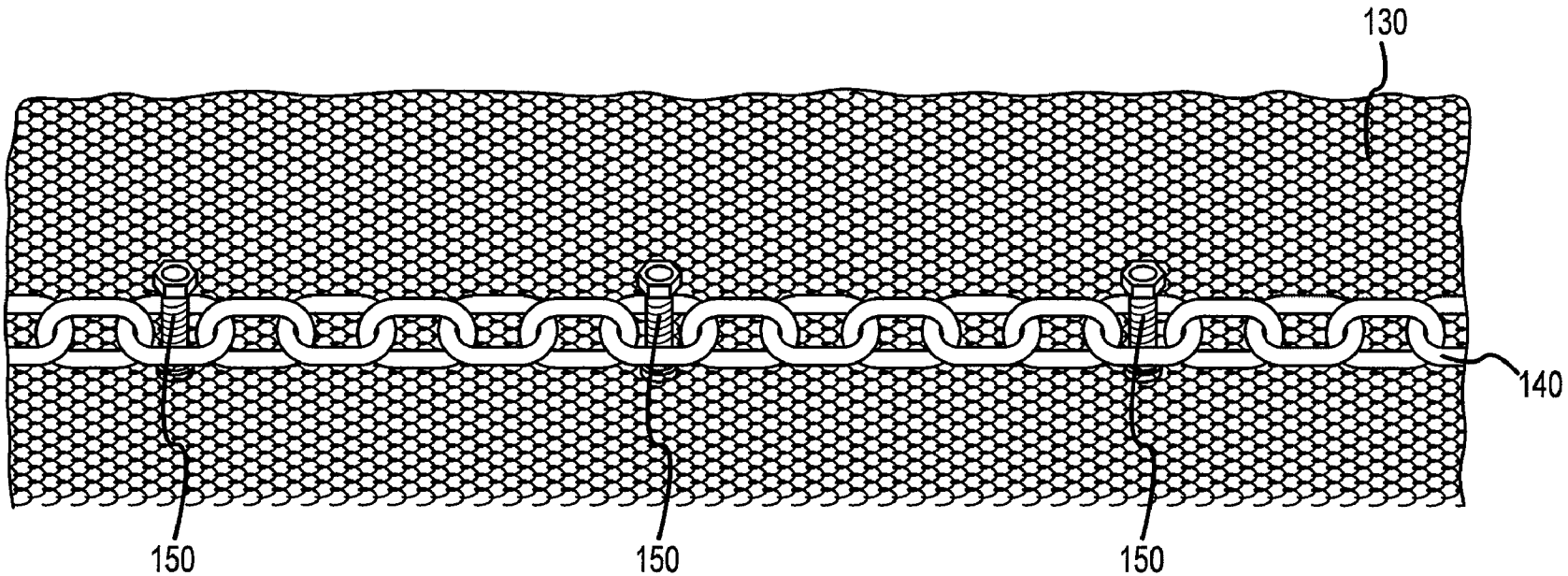
FIGS. 6 and 7 are drawings of an attachment of a reinforcement strip to a mesh curtain according to an embodiment of the invention.
Figure 7:
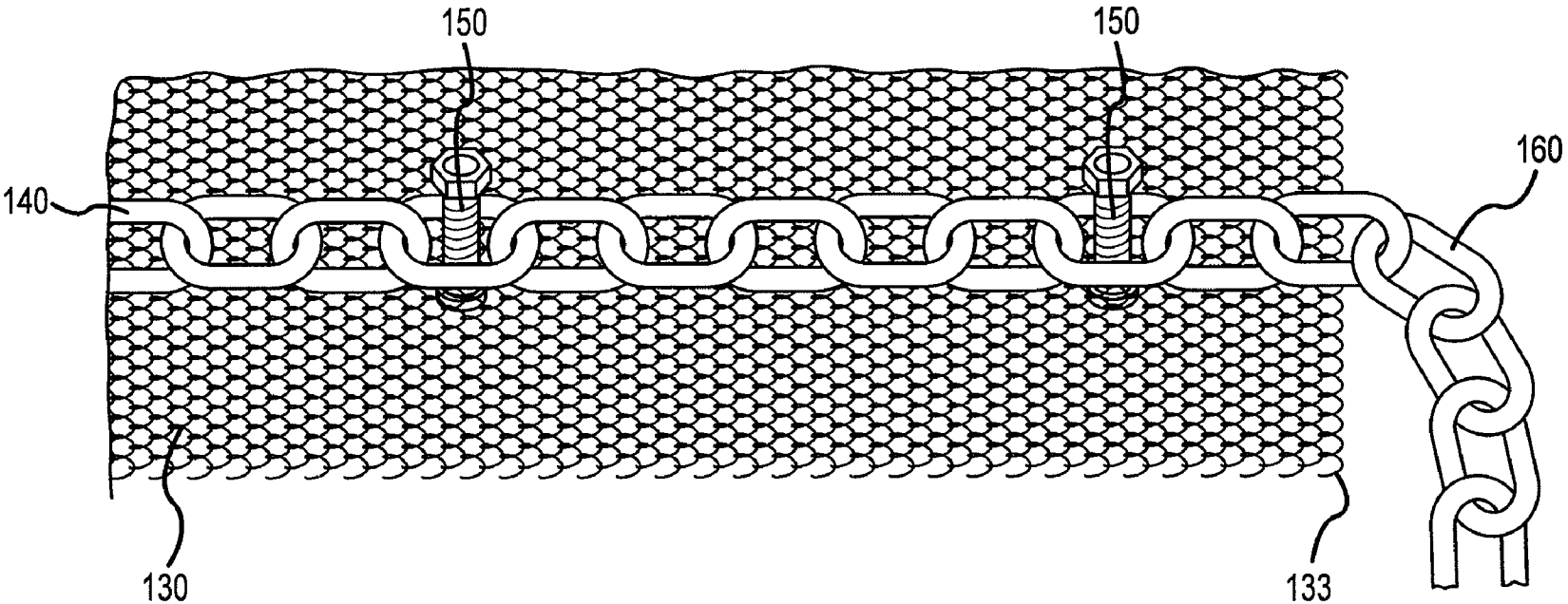

FIGS. 6 and 7 illustrate attachment of a reinforcement strip 140 to a mesh curtain 130 according to an embodiment of the invention. The reinforcement strip 140 is illustrated in FIGS. 6 and 7 as a chain, however, other reinforcement devices may be used as well. The reinforcement strip 140 is attached to the mesh curtain 130 at multiple attachment points by threaded fasteners 150, for example, a bolt and nut. In some embodiments, a nut having a nylon bushing is threaded onto the bolt such that the nylon bushing prevents the nut from coming loose while allowing the reinforcement strip 140 to move freely on the bolt shank and/or threaded portion. As previously discussed, in some embodiments the reinforcement strip 140 includes an excess portion 160. As will be explained in more detail below, the portion 160 may be anchored to a wall, ceiling, floor, or other structure to prevent an edge of the mesh curtain 130 opposite of the attachment edge from flipping away while the mesh curtain billows when impacted by airborne debris.

Figure 8:
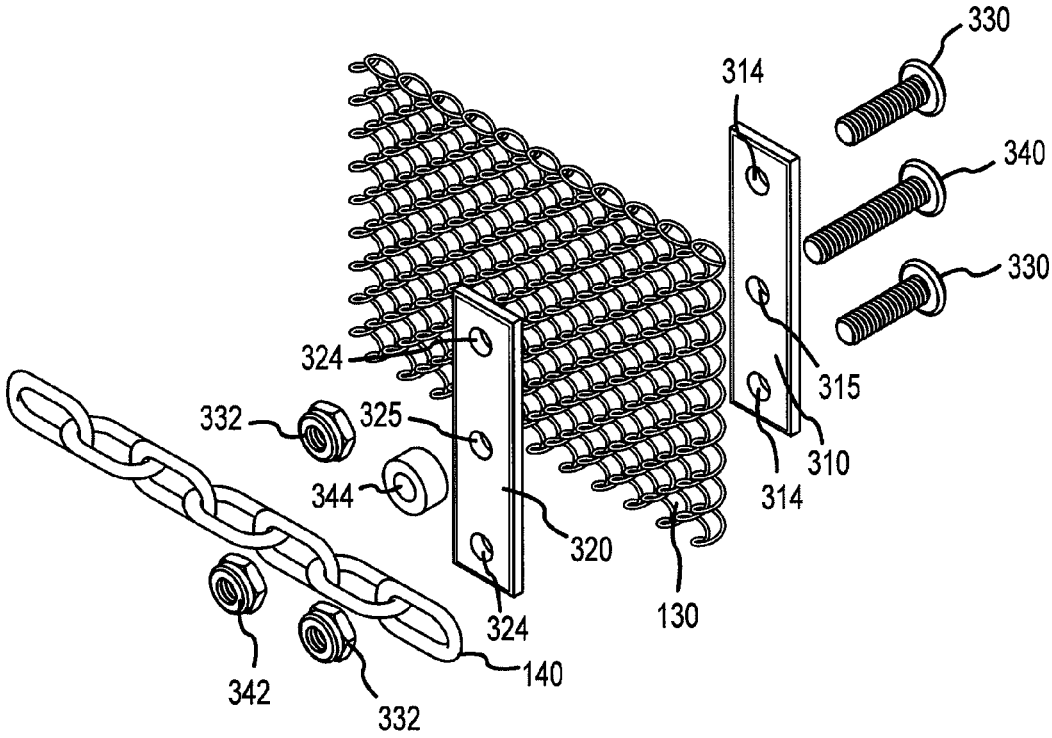
FIG. 8 is an exploded drawing of a reinforcement strip end plate system according to an embodiment of the invention.

FIG. 8 illustrates a reinforcement strip end plate system 300 according to an embodiment of the invention. The reinforcement strip end plate system 300 may be used to attach a reinforcement strip (e.g., reinforcement strip 140, 142, 180, or reinforcement strip 230) to a mesh curtain 130, for example, proximate a side edge 133 of the mesh curtain 130. The reinforcement end plate system 300 provides a reinforced attachment point to prevent the reinforcement strip 140 from tearing away from the mesh curtain 130 when it billows and expands under the impact of airborne debris. The reinforcement strip end plate system 300 includes a first plate 310 and a second plate 320. Fasteners 330, for example, threaded fasteners, fit through holes 314 in the first plate 310 and through the mesh of the mesh curtain 130. The fasteners 330 fit through holes 324 in the second plate and are secured by nuts 332, thereby clamping the mesh curtain 130 between the first and second plates 310, 320. A fastener 340 attaches the reinforcement strip 140 to the reinforcement strip end plate system 300 by fitting through hole 315 in the first plate 310 and through the mesh curtain 130. The fastener 340 further fits through hole 325 in the second plate 320 and through an opening in the reinforcement strip 140 and a spacer 344 to be secured by nut 342. As a result, the reinforcement strip is secured to the mesh curtain 130 and the mesh curtain 130 is further clamped between the first and second plates 310, 320. The heads of fasteners 330, 340 may be hidden by bunching of the mesh curtain 130 at the side edges. For example, excess mesh curtain may be provided by trapping in the track multiple carriers near the side edges, resulting in bunched material that can be folded over to cover the reinforcement strip end plate system. The folded over portion may be secured by weaving a length of coil into the overlapping portion and the main portion of the mesh curtain.

Figure 9:
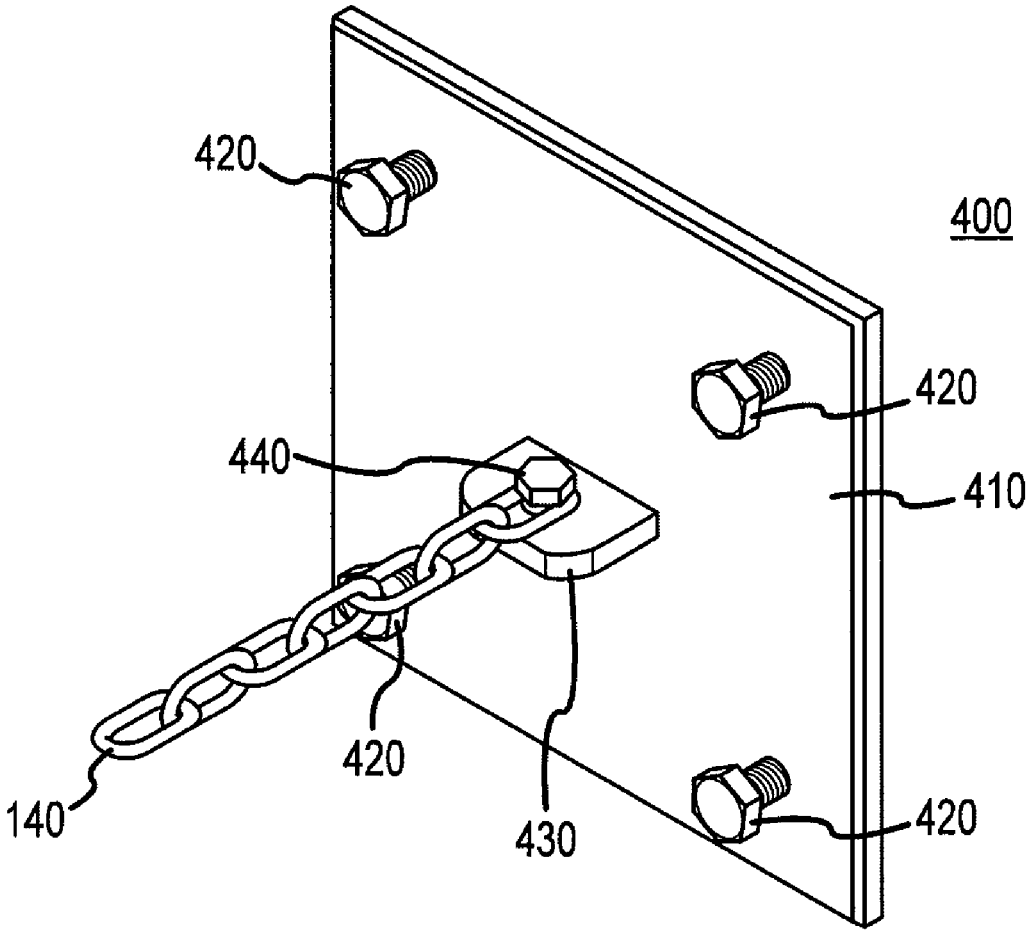
FIG. 9 is a drawing of a wall anchor according to an embodiment of the invention.

FIG. 9 illustrates an anchor 400 according to an embodiment of the invention. The anchor 400 includes a mounting plate 410 configured to be attached to a surface, for example, a wall by fasteners 420. More generally, the anchor 400 may be attached to a wall, floor, ceiling, or other surface to which a reinforcement strips is to be anchored. Fasteners 420 are illustrated in FIG. 9 as threaded fasteners, however, other types of fasteners may be used as well. A reinforcement strip 140 is attached to mount 430, which is attached to the mounting plate 410. A fastener 440 secures the reinforcement strip 140 to the mount 430. The anchor 400 may be used to attach a reinforcement strip (e.g., reinforcement strips 140, 180, and/or 430) to prevent a mesh curtain from flipping away from the wall as it billows and expands when impacted by airborne debris. The anchor 400 may be used to secure a reinforcement strip attached to a mesh curtain proximate its upper edge to provide reinforcement and additional strength to the upper portion of the mesh curtain. For example, the reinforcement strip may strengthen the attachment of the carriers to the mesh curtain and to the track, and may also provide a secondary system for the upper edge to prevent it from blowing out in the event the track fails or the track is torn from the wall.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A debris entrapment system comprising: a track having a guide and configured to be mounted proximate a window opening; a metal mesh curtain having an attachment edge, the metal mesh curtain further having first and second opposite edges; a plurality of slidable carriers attached proximate the attachment edge of the metal mesh curtain and configured to fit with the guide and be slidably attached to the track;

a first plurality of trapped carriers attached proximate the attachment edge and the first edge of the metal mesh curtain and a second plurality of trapped carriers attached proximate the attachment edge and the second edge of the metal mesh curtain, and the trapped carriers configured to fit with the guide and trapped from sliding along the guide; and a reinforcement strip with a plurality of links, wherein one or more of said links is attached to the metal mesh curtain a location corresponding to a respective pleat of the metal mesh curtain and corresponding to a respective slidable carrier, and wherein first and second end of the reinforcement strip are configured to extend from the metal mesh curtain and be attached to a structure.

2. The debris entrapment system of claim 1 wherein the reinforcement strip comprises a chain.

3. The debris entrapment system of claim 1, further comprising first and second wall mounts configured to be fixed to a wall having the window opening and to which the first and second ends are attached, respectively.

4. The debris entrapment system of claim 1 wherein the reinforcement strip is attached to the metal mesh curtain using a plurality of threaded fasteners.

5. The debris entrapment system of claim 1 wherein the reinforcement strip is a first reinforcement strip and the debris entrapment system further comprises a second reinforcement strip attached to the metal mesh curtain.

6. The debris entrapment system of claim 5 wherein the first reinforcement strip is attached to the metal mesh curtain at a plurality of first regularly spaced attachment points and the second reinforcement strip is attached to the mesh curtain at a plurality of second regularly spaced attachment points, a first distance along the first reinforcement strip between two adjacent first regularly spaced attachment points greater than a second distance along the second reinforcement strip between two adjacent second regularly spaced attachment points.

7. The debris entrapment system of claim 5 wherein the first reinforcement strip is attached proximate a bottom edge of the metal mesh curtain and the second reinforcement strip is attached proximate a top edge of the metal mesh curtain.

8. The debris entrapment system of claim 5 wherein the plurality of slidable and trapped carriers are attached to the metal mesh curtain and the second reinforcement strip.

9. The debris entrapment system of claim 5 wherein ends of the second reinforcement strip are configured to be attached to a wall having the window opening.

10. The debris entrapment system of claim 1 wherein the reinforcement strip is attached proximate an edge of the metal mesh curtain opposite the attachment edge.

11. The debris entrapment system of claim 1, further comprising a plurality of brackets configured to mount to a surface of a wall having the window opening and position the track proximate the window opening.

12. The debris entrapment system of claim 1 wherein the track is mounted directly to a building structure.

13. A debris entrapment system, comprising:

a track;

a mesh curtain having a side edge fixedly attached to the track and an attachment edge slidably attached to the track using a plurality of carriers, the mesh curtain further having an edge opposite the attachment edge;

a first chain including a plurality of first links, one or more of said first links attached to the mesh curtain at a first plurality of attachment points proximate the edge opposite of the attachment edge, and wherein the first plurality of attachment points correspond to pleats of the mesh curtain and to respective ones of the plurality of carriers; and a second chain including a plurality of second links, one or more of said second links attached to the mesh curtain at a second plurality of attachment points proximate the attachment edge; and wherein at least one of the first and second chains is configured to extend from the mesh curtain and be attached to a surface.

14. The debris entrapment system of claim 13 wherein the mesh curtain has a coil mesh construction.

15. The debris entrapment system of claim 13 wherein the mesh curtain comprises a multi-layer mesh curtain.

16. The debris entrapment system of claim 13 wherein the first chain prevents the mesh curtain from fully expanding the pleats proximate the attachment points of the first chain.

17. The debris entrapment system of claim 13 wherein the mesh curtain comprises a metal mesh of interlocking metal coils.

18. The debris entrapment system of claim 17 wherein the metal mesh curtain comprises interlocking metal coils of at least one of stainless steel, carbon steel, aluminum, or combinations thereof.

19. The debris entrapment system of claim 13 wherein a distance between two adjacent attachment points of the first plurality of attachment points is different than a distance between adjacent attachment points of the second plurality of attachment points.

20. The debris entrapment system of claim 19 wherein the mesh curtain is pleated and each of the second plurality of attachment points correspond to a respective pleat of the mesh curtain.

21. The debris entrapment system of claim 13 wherein the side edge of the mesh curtain is fixedly attached to the track using trapped roller carriers, and wherein the trapped roller carriers are trapped in the guide channel by a carrier stop and an end stop attached to the track.

22. The debris entrapment system of claim 13 wherein the attachment edge is attached to the track using roller carriers, wherein the side edge of the mesh curtain is attached to the track using trapped roller carriers, and wherein the trapped roller carriers are attached to the curtain closer together than the roller carriers.

23. The debris entrapment system of claim 13 wherein the chain is attached to the mesh curtain with at least one mounting plate assembly.

24. The debris entrapment system of claim 13 wherein the mounting plate assembly comprises a first mounting plate configured to be placed against a first surface of the mesh curtain, a second mounting plate configured to be placed against a second surface of the mesh curtain opposite the first surface; and at least one threaded fastener configured to be threaded into at least one of the first and second mounting plates and further configured to attach the chain thereto.

25. The debris entrapment system of claim 1, wherein an amount of pleated material is varied by varying a distance between attachment points of the reinforcement strip.

* * * * *